US008797161B2

(12) United States Patent
Aflalo

(10) Patent No.: US 8,797,161 B2
(45) Date of Patent: Aug. 5, 2014

(54) SHIPPING CONTAINER VENT COVER FOR THEFT DETECTION, THEFT PREVENTION AND LOGISTICS MANAGEMENT

(75) Inventor: Amit Aflalo, Shoham (IL)

(73) Assignee: Loginno Logistic Innovation Ltd., Shoham (IL)

( * ) Notice: Subject to any disclaimer, the term of this patent is extended or adjusted under 35 U.S.C. 154(b) by 148 days.

(21) Appl. No.: 13/320,474

(22) PCT Filed: Mar. 9, 2010

(86) PCT No.: PCT/IB2010/051003

§ 371 (c)(1), (2), (4) Date: Dec. 15, 2011

(87) PCT Pub. No.: WO2010/133980

PCT Pub. Date: Nov. 25, 2010

(65) Prior Publication Data

US 2012/0075100 A1 Mar. 29, 2012

Related U.S. Application Data

(60) Provisional application No. 61/180,142, filed on May 21, 2009.

(51) Int. Cl.
*G08B 13/14* (2006.01)

(52) U.S. Cl.
USPC ..... 340/568.1; 340/572.9; 340/614

(58) Field of Classification Search
USPC ..... 340/568.1, 572.1–572.9, 567, 552, 561, 340/568.8, 569, 568.5–568.7, 571, 581, 340/612–614
See application file for complete search history.

(56) References Cited

U.S. PATENT DOCUMENTS 5,240,027 A * 8/1993 Vertanen ..... 137/73
6,339,397 B1 1/2002 Baker (Continued)

FOREIGN PATENT DOCUMENTS

DE 102006025214 B3 11/2007
WO 2006019929 A2 2/2006

OTHER PUBLICATIONS

International Search Report dated Sep. 27, 2010 in corresponding International Application No. PCT/IB2010/051003.

*Primary Examiner* — Daniel Previl
(74) *Attorney, Agent, or Firm* — Dr. Hanan Farber Patent Agent Ltd.

(57) ABSTRACT

A vent cover (16) for installing on a shipping container. The vent cover includes a housing (16*a*) adapted for covering a vent hole (24) of the shipping container. A direct current (DC) power source is encased or enclosed in the housing. The DC power source includes a battery. The vent cover may also include a circuit board (34) attached to the DC power source. An antenna (36) may be located on a surface of the housing and attached to the circuit board. The circuit board may include a satellite antenna interface for a satellite antenna and a global positioning system (GPS) module attached to the satellite antenna interface. The vent cover may include an environmental sensor (304) for sensing a parameter of the shipping container. The environmental sensor may be adapted to protrude through a hole in a wall (12) of the shipping container when the vent cover is mounted on the shipping container. The electromagnetic sensor may be configured to transmit an electromagnetic signal (324) and sense an electromagnetic response signal (322) responsive to the transmitted wave and sensitive to variations within the container.

15 Claims, 7 Drawing Sheets

(56) References Cited

U.S. PATENT DOCUMENTS

| | | | | |
|---|---|---|---|---|
| 6,367,646 | B1 * | 4/2002 | Hoagland et al. | 220/533 |
| 6,489,623 | B1 * | 12/2002 | Peters et al. | 250/506.1 |
| 6,879,807 | B2 * | 4/2005 | Fox et al. | 455/11.1 |
| 7,317,387 | B1 * | 1/2008 | Cova et al. | 340/539.1 |
| 7,525,431 | B2 * | 4/2009 | Britton et al. | 340/572.1 |
| 7,646,301 | B2 * | 1/2010 | Waterhouse et al. | 340/572.1 |
| 2003/0227382 | A1 | 12/2003 | Breed | |
| 2007/0075075 | A1 * | 4/2007 | Jaeger et al. | 220/1.5 |
| 2008/0000467 | A1 * | 1/2008 | Dudley et al. | 126/25 B |
| 2008/0278318 | A1 | 11/2008 | Auerbach et al. | |
| 2010/0164710 | A1 * | 7/2010 | Chung et al. | 340/539.1 |

* cited by examiner

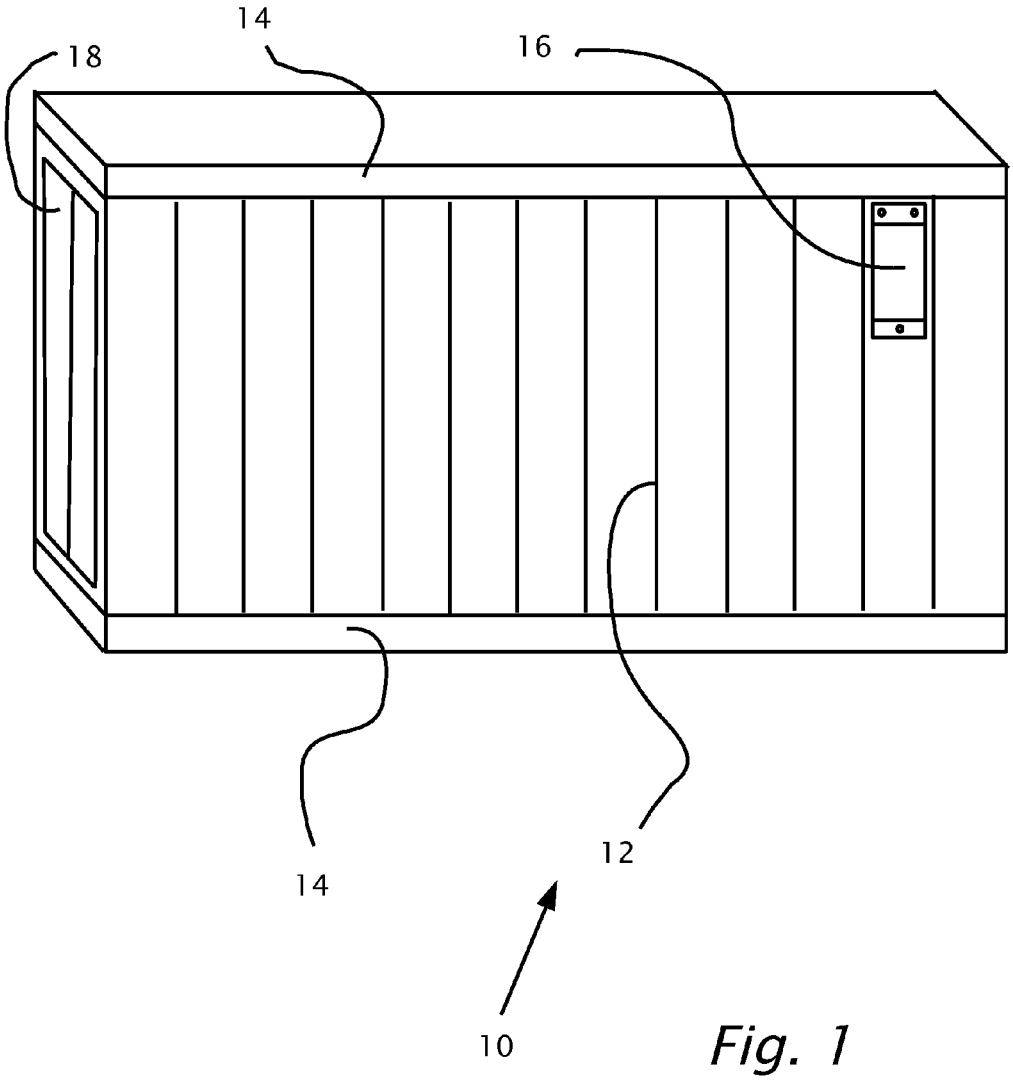
Fig. 1
Conventional
Art

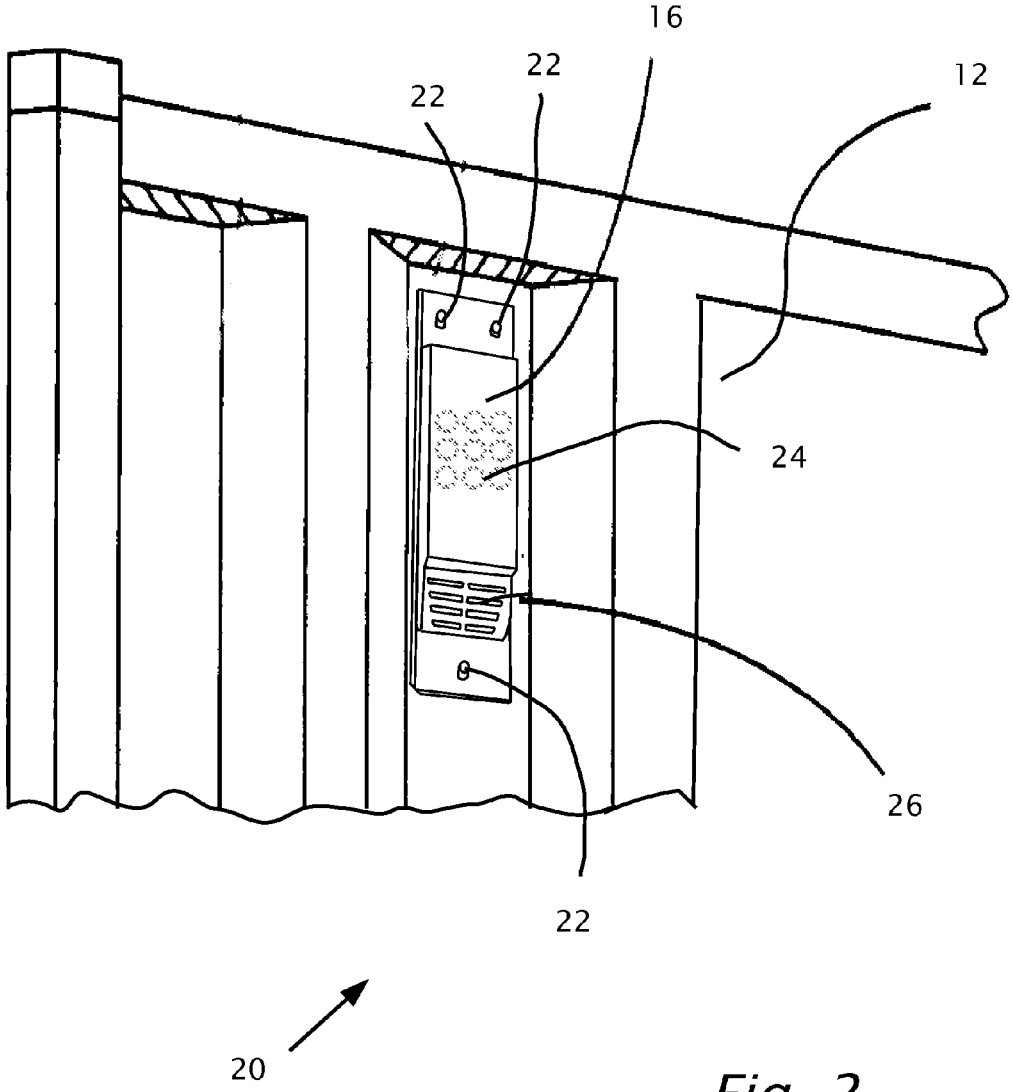
Fig. 2
Conventional
Art

SHIPPING CONTAINER VENT COVER FOR THEFT DETECTION, THEFT PREVENTION AND LOGISTICS MANAGEMENT

BACKGROUND

1. Technical Field

The present invention relates to securing a shipping container and its contents against theft or intrusion and logistics management of containers' locations around the world.

2. Description of Related Art

Shipping containers are used to transport goods all over the world. Many shipping containers are monitored to maintain a log of their whereabouts, as well as to monitor their estimated time of delivery to a given port or destination. There are millions of shipping containers in use today, and they typically transport billions of dollars worth of goods around the globe.

Reference is now made to FIG. 1 which shows a rectangular shipping container 10, according to conventional art. Typically containers 10 are made in varying shapes, sizes and specifications in order to best transport goods or items being shipped. Beams 14 connect sides 12 to roof and floor of container 10 and provide for the mounting of access doors 18. Doors 18 are used to access the space where goods/items are stored prior to transportation. Sides 12 may be corrugated and typically the space between corrugations is used to locate a vent cover 16. Vent cover 16 is typically located in a space between corrugations to avoid damage to vent cover 16. Vent cover 16 may also be located on side 12 near to doors 18. A purpose of vent cover 16 is to cover ventilation holes 24 (not shown) which typically provide ventilation between the interior and exterior of container 10.

Reference is now made to FIG. 2 which shows a closer isometric view 20 of vent cover 16 mounted on side 12 of container 10. Vent cover 16 is attached to side 12 between protruding sections of side 12 using mechanical fasteners 22. Fasteners 22 may typically be rivets or nuts and bolts. Vent cover 16 may additionally be more hermetically attached to side 12 with a silicone sealant or gasket arrangement placed between wall 12 and vent cover 16. The silicone sealant or gasket serves to stop water (rain or sea water) for example from getting into container 10 via vent holes 24 (shown in dotted lines) in container wall 12 behind vent cover 16. Vent holes 24 are through-holes in side 12 which provide ventilation and/or pressure equalization between the interior and exterior of container 10. Holes 24 may be covered with a gauze filter, semi-breathable membrane or restricted to a certain size. Holes 24 allow the escape of any gases built up inside container 10 as well as to regulate temperature or humidity inside container 10 for example. Vent cover 16 typically provides additional protection of contents inside container 10 from the environment outside container 10. Vent cover 16 may also have ventilation slots 26 at the bottom of vent cover 16 to allow air flow to and from holes 24.

The term "enclosed" as used herein refers to closing with a closure which may be opened or disassembled after use.

The term "encased" as used herein refers to permanently encasing such as by casting and curing a resin with an object inside.

The terms "vent" and "vent hole(s)" are used herein interchangeably to refer to one or more openings in the shipping container which allows transfer of gas between the interior and exterior of the shipping container.

BRIEF SUMMARY

According to embodiments of the present invention, there is provided a vent cover for installing on a shipping container.

The vent cover includes a housing adapted for covering a vent hole of the shipping container. A direct current (DC) power source is encased or enclosed in the housing. The DC power source includes a battery. The DC power source e.g. replaceable battery, may be enclosed in the housing. Alternatively, the DC power source may be encased in the housing and the DC power source may be a rechargeable battery. The rechargeable battery may be chargeable by mutual inductance through the housing or any other charging methods, for example: a solar panel. The vent cover may also include a circuit board operatively attached to the DC power source. An antenna may be located on a surface of the housing and operatively attached to the circuit board. The circuit board may include a satellite antenna interface for a satellite antenna and a positioning module such as global positioning system (GPS) module attached to the satellite antenna interface. The circuit board may also include a second antenna interface and a communications transceiver attached to the second antenna interface. The vent cover may include an environmental sensor for sensing a parameter of the shipping container. The environmental sensor connected to the circuit board may be adapted to protrude through a hole in a wall of the shipping container when the vent cover is mounted on the shipping container. The environmental sensor may be an electromagnetic sensor, thermal, humidity, motion sensor, gas sensor, pressure sensor, optical sensor and/or acoustic sensor. The electromagnetic sensor may be configured to transmit an electromagnetic signal and sense an electromagnetic response signal responsive to the transmitted electromagnetic signal. A wavelength of the transmitted electromagnetic signal may be selected to correspond to a full-wave, half-wave or quarter-wave of a dimension of the container so that the container responds to the transmitted wave as an electromagnetic cavity and the electromagnetic response is sensitive to variations within the cavity.

According to embodiments of the present invention there is provided a vent cover for installing on a shipping container. The vent cover includes a housing adapted for attaching over a vent hole of the shipping container. An electromagnetic sensor extends from the housing and is adapted to transmit an electromagnetic signal and sense an electromagnetic response signal responsive to the transmitted electromagnetic signal. A wavelength of the transmitted electromagnetic signal is selected to correspond to a full-wave, half-wave or quarter-wave of a dimension of the container so that the container responds to the transmitted wave as an electromagnetic cavity and the response electromagnetic is sensitive to variations within the cavity.

According to embodiments of the present invention there is provided a method for securing a shipping container. An electromagnetic signal is transmitted into a space of the shipping container. A response signal is sensed which is responsive to the electromagnetic signal in the space and based on the response signal a potential theft may be alerted. The transmitting and the sensing may be performed periodically as part of a monitoring mode. During the alert, the monitoring mode is changed to an active mode. In the active mode, the alert of potential theft is communicated by a communication system. The communication system may be a satellite link, a wide area network (WAN), a local area network (LAN), a global system for mobile communications (GSM) gateway, a portable cellular cell or any other communication method. The transmission may be sent and the sensing may be performed using power from a direct current power source encased or enclosed in a housing mounted as a vent cover of a shipping container.

BRIEF DESCRIPTION OF THE DRAWINGS

The invention is herein described, by way of example only, with reference to the accompanying drawings, wherein:

FIG. 1 shows a rectangular shipping container , according to conventional art.

FIG. 2 shows a closer isometric view of vent cover mounted on the side of the shipping container of FIG. 1, according to conventional art.

DETAILED DESCRIPTION

Figure 3A:
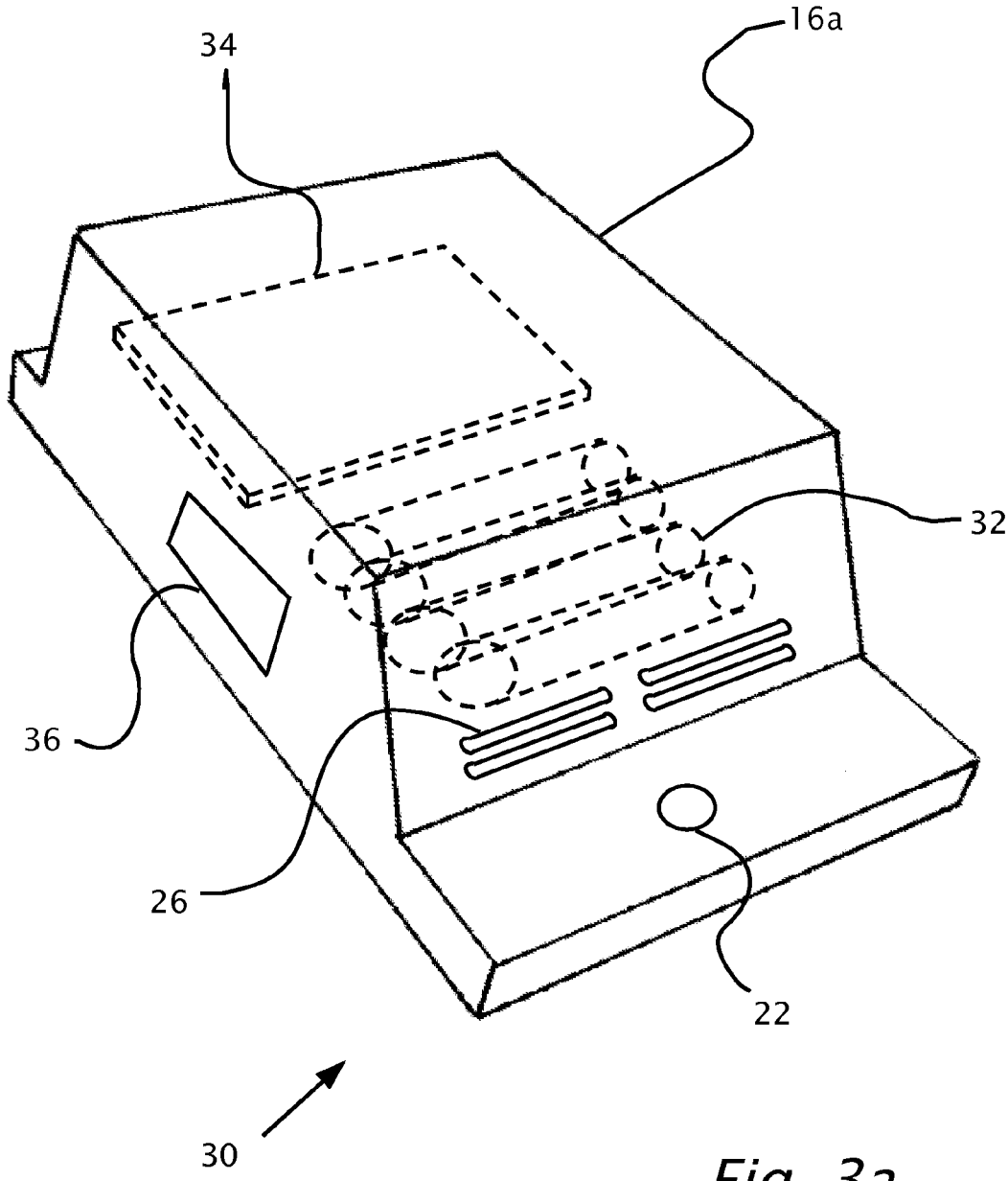
FIG. 3*a* shows an isometric view of a housing used to secure a shipping container, according to an embodiment of the present invention.

Reference will now be made in detail to embodiments of the present invention, examples of which are illustrated in the accompanying drawings, wherein like reference numerals refer to the like elements throughout. The embodiments are described below to explain the present invention by referring to the figures.

Before explaining embodiments of the invention in detail, it is to be understood that the invention is not limited in its application to the details of design and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

By way of introduction, embodiments of the present invention are directed to securing against theft a shipping container and its contents. Embodiments of the present invention may alternatively or in addition be useful for logistics management of shipping containers and/or their contents. According to a feature of the present invention a circuit board and power supply for the circuit board is provided in a housing which looks like vent cover 16 mounted on the side of a shipping container.

In embodiments of the present invention the circuit board and the power supply preferably are mounted in a housing as part of injection molding or other manufacturing process used to form the housing or the circuit board and/or power supply is mounted in the housing after manufacture of the housing. Vent holes on the exterior wall of the container may be used to allow sensing of the container interior. The vent holes may be situated at a standard place in the wall of the container or at a non-standard place on the container. The "vent holes" may be drilled, bored or punched or otherwise formed when the vent cover according to embodiments of the present invention is installed on the shipping container.

Referring now to the drawings, reference is now made to FIG. 3*a* which shows an isometric view 30 of a housing 16*a* used to secure a shipping container 10 according to an embodiment of the present invention. Housing 16*a* like vent cover 16 is attached to a container 10 via fasteners 22 and typically also performs the function of allowing air to flow between the interior and exterior through ventilation slots 26. To an observer, housing 16*a* attached to container 10 looks no different than housing 16 attached to container 10. Circuit board 34, battery holder 32 and/or one or more antennas 36 are mounted inside or on surface of housing 16*a* in such a way that housing 16*a* is visually indistinguishable from vent cover 16 when mounted on shipping container 10. Battery holder 32 typically may hold for instance one or more standard AA or AAA size replaceable batteries or rechargeable batteries such as nickel cadmium (NiCad) types. The batteries, when mounted in battery holder 32, supply direct current power to circuit board 34 during operation.

Figure 3B:
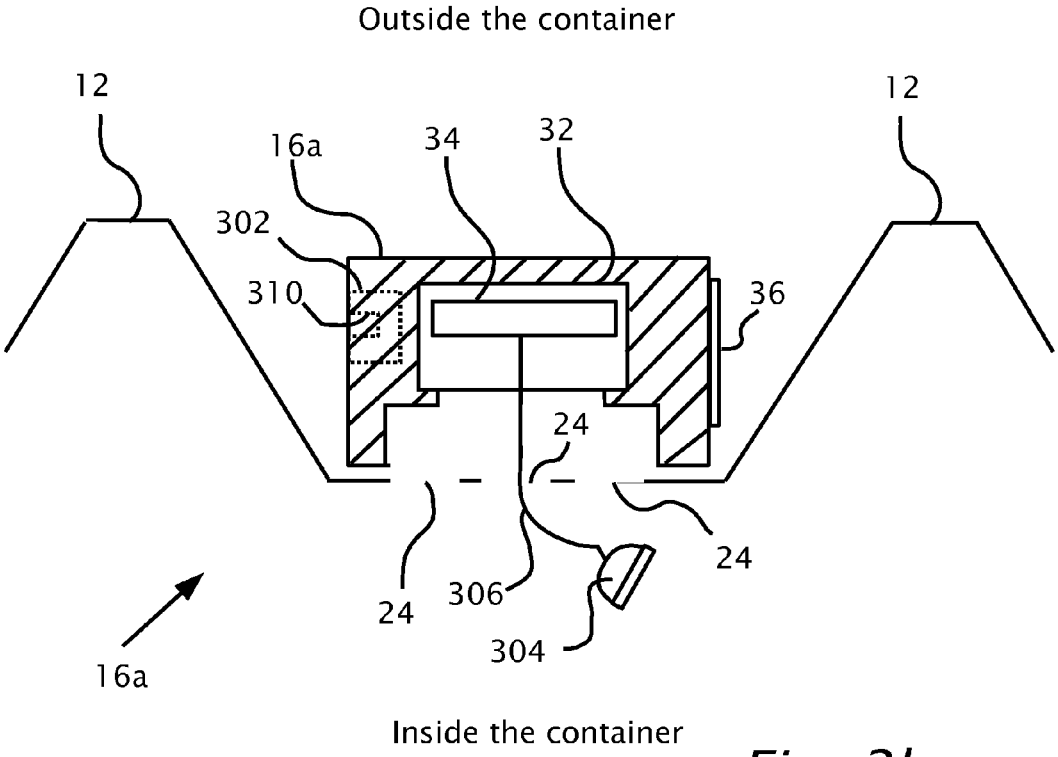
FIG. 3*b* shows a cross-sectional detail of housing of FIG. 3*a*, according to an aspect of the present invention.

Reference is now made to FIG. 3*b* which shows a cross-sectional detail of housing 16*a* according to an embodiment of the present invention. Housing 16*a* is shown attached to flat surface of wall 12 between corrugated sections of wall 12 and mounted on the outside of a shipping container 10. A transducer 304, e.g. electromagnetic transducer, is located on the inside of container 10 and is attached to circuit board 34 with cable 306. Cable 306 connects board 34 to transducer 304 through ventilation hole 24. Multiple ventilation holes 24 may allow for multiple sensors, transducers or antennas to be located inside container 10 which may be connected to circuit board 34. Multiple sensors, transducers or antennas located inside container 10 typically may allow for sensing of temperature, humidity, pressure, air quality, motion, along with the removal and placement of objects inside container 10.

Antenna 36 is connected to circuit board 34 and may be disposed on the inside of housing 16*a* (along with board 34 and battery holder 32) if housing 16*a* is made from an electrically non-conductive material. If housing 16*a* is made from electrically conductive material such as metal, antenna 36 may be mounted outside the exterior surface of housing 16*a*. Antenna 36 is typically located and orientated to allow for either vertical and/or horizontal polarization. Antenna 36 is shown externally on a vertical face of housing 36 by way of example only. One or more antennas 36 may be placed on other external faces of housing 16, disposed internally within housing 36 and/or as part of circuit board 34.

Circuit board 34, battery holder 32 and/or batteries (not shown) may be cast inside of housing 16*a* as part of the manufacturing process, e.g. injection molding, of housing 16*a*. The manufacturing process, may include use of either thermoplastic or thermoset, e.g. epoxy, urethane materials. Alternatively battery holder 32 and/or circuit board 34 may be mounted inside of housing 16*a* using conventional attachment means known in the art subsequent to injection molding.

A mutual inductive coupling 302, on the inside of housing 16*a*, may be used for charging re-chargeable batteries. Coupling 302 may have an aperture 310 which provides a mutual inductive coupling to a secondary magnetic core. Mutual inductive coupling 302 has a secondary winding which is wound around the secondary magnetic core. The secondary winding provides a low voltage alternating current (AC) output when a primary magnetic core (with a primary winding connected to mains electricity) is inserted into the aperture 310 of coupling 302. The low voltage AC output of the secondary winding is rectified to provide a direct current (DC) used for charging batteries in battery holder 32 when batteries are re-chargeable. Batteries in battery holder 32 may need to be re-charged or replaced prior to the shipping and delivery of a container 10. When the batteries in battery holder 32 are replaced, typically when container 10 is being reloaded, housing 16*a* is removed from the side of container 10 by unfastening fasteners 22, the batteries in battery holder 32 are replaced and housing 16*a* is re-attached to container 10 using fasteners 22. Alternatively, batteries may be recharged using solar and/or wind power from an external power generation device, e.g. solar panel, wind turbine.

Figure 3C:
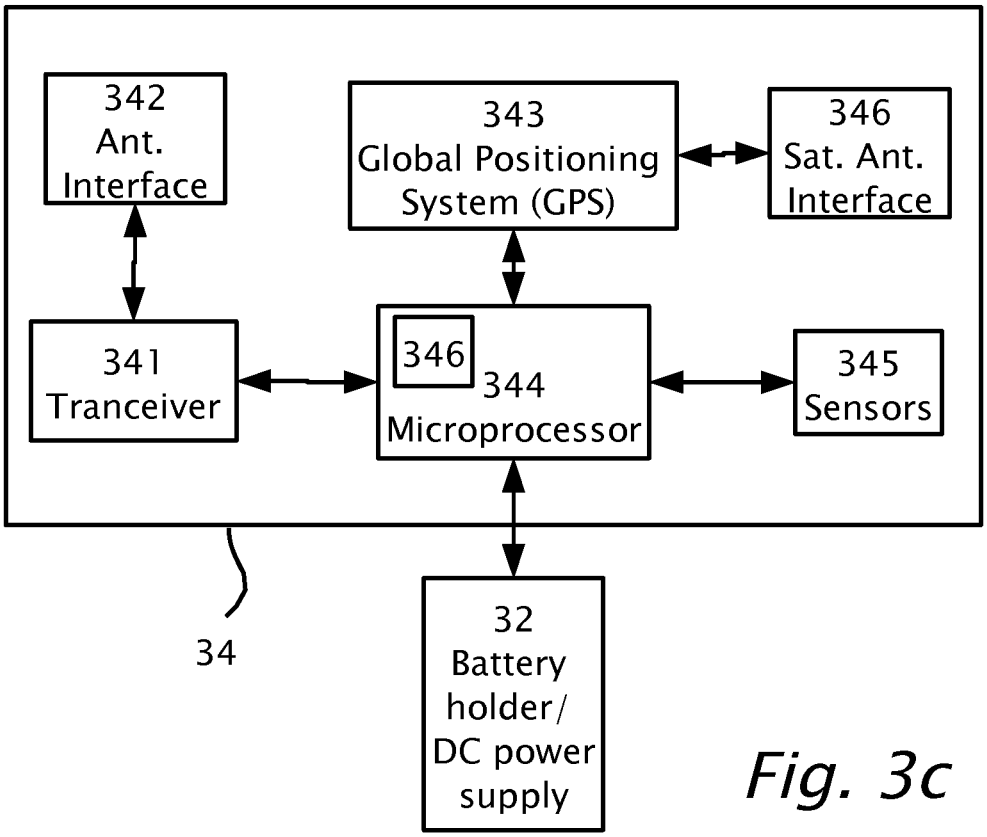
FIG. 3*c* which shows a block diagram of a circuit board, according to a feature of the present invention.

Reference is now also made to FIG. 3*c* which shows further details of circuit board 34 according to an aspect of the present invention. Circuit board 34 is powered by batteries placed in battery holder 32. Circuit board 34 includes an antenna interface 342 which allows one or multiple antennas 36 to be connected to one or more transmitters, receivers and/or transceivers. A single transceiver 341 and a single antenna interface 342 is shown, by way of example only. Transceiver 341 may be for a global system for mobile communications (e.g. GSM transceiver, and/or for a wireless local area network or wireless wide area network. Optionally, a satellite receiver 343 for global positioning system (GPS) may be attached to a port 346 for a satellite antenna externally mounted in or outside housing 16*a*. Both satellite receiver 343 and transceiver 341 are operatively connected to a processor 344 (with memory 346 built in and/or attached thereto) along with a sensor interface 345. Sensor interface 345 allows data to be sent and received from one or multiple sensors 304 located inside container 10. The data are typically processed by processor 344. Interface 345 typically may provide the function of sample and hold and appropriate analogue to digital (A/D) and digital to analogue (D/A) conversion of data sent and received between processor 344 and multiple sensors located inside container 10.

Figure 3D:
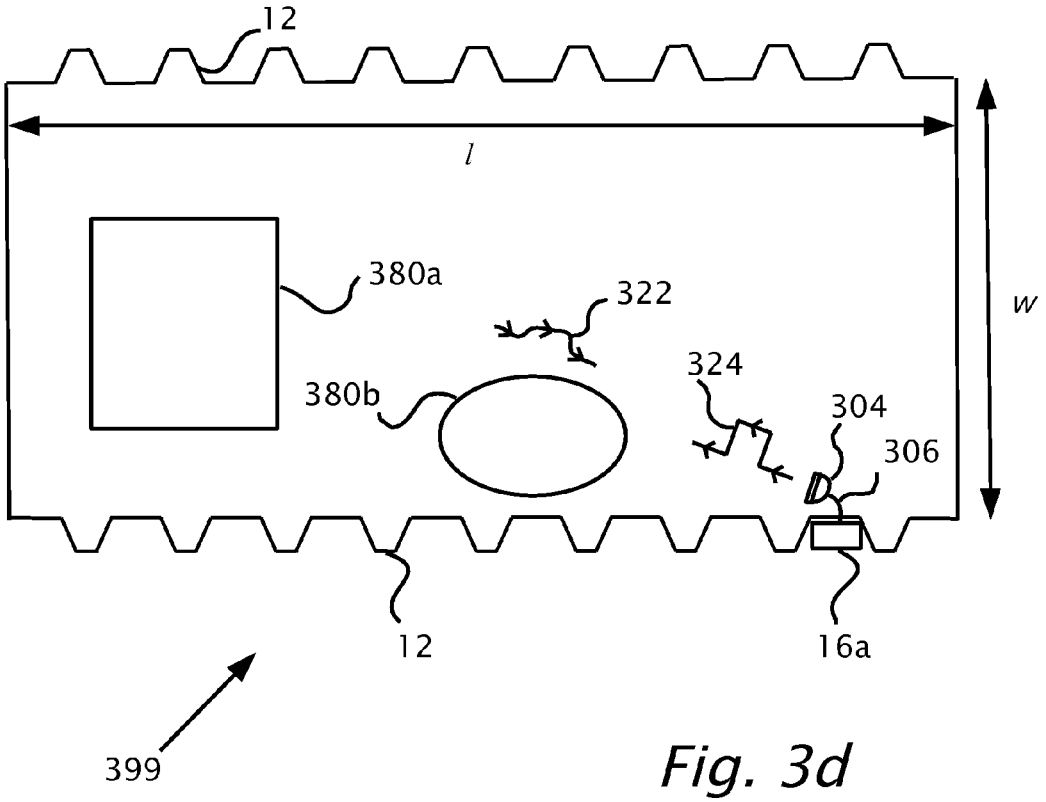
FIG. 3*d* shows a cross sectional plan view of rectangular container and an electromagnetic signal inside container according to an exemplary embodiment of the present invention.

Reference is now also made to FIG. 3*d* which shows a cross sectional plan view 399 of rectangular container 10 and an electromagnetic signal 324 inside container 10 according to an exemplary embodiment of the present invention. Housing 16*a* is mounted between corrugated sections of wall 12. Walls 12 have a length l which is typically around 12.2 meters and a width w which is typically around 2.4 meters and height h (not shown) typically around 2.5 meters. Items inside container 10 which are to be shipped are shown as items 380*a* and 380*b*. Electromagnetic transducer 304 is typically located near a corner of container 10 and is connected to housing 16*a* using cable 306 through one of vent holes 24 (not shown). Transducer 306 connected to processor 344 is used to detect the proximity and movement of objects 380*a*, 380*b*. Transducer 306 typically emits an electromagnetic signal or pulse 324 and also senses a change in return signal 322. Emitted signal 324 typically may be an acoustic signal, an electromagnetic signal or infra red signal.

Figure 3E:
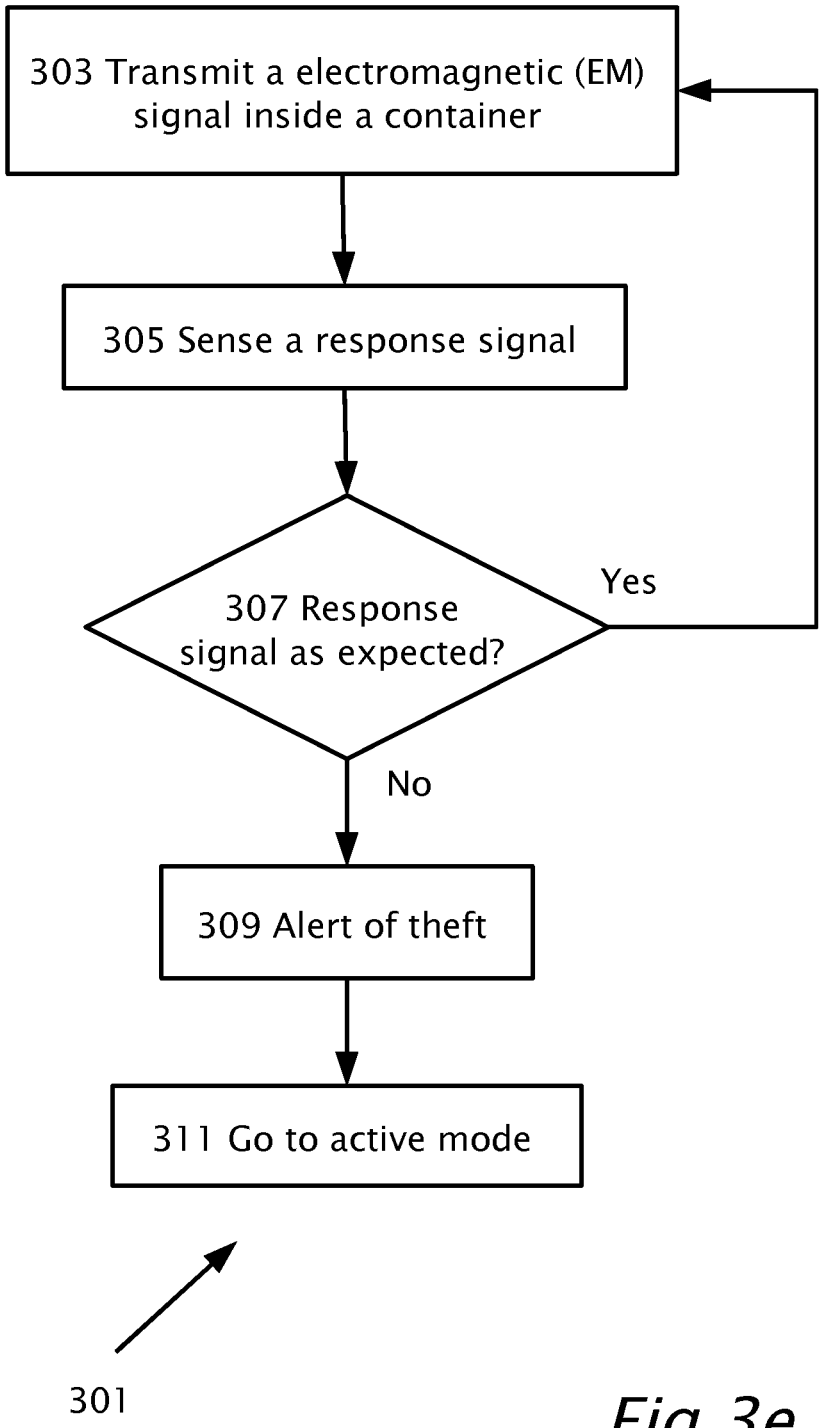
FIG. 3*e* shows a method used to secure a shipping container, according to a feature of the present invention.

Reference is now made to FIG. 3*e* which shows a method 301 used to secure a shipping container 10 against theft according to an embodiment of the present invention. Electromagnetic transducer 306 transmits an electromagnetic signal 324 inside container 10 (step 303). Step 303 may be performed periodically (once an hour for example) as part of a monitoring mode which is used to save battery power of batteries in holder 32. An electromagnetic signal may be selected within a frequency band which has a full wave, half-wave or quarter-wave corresponding or similar to one of the dimensions of container 10, preferably at low power or within a citizen's band.

For example, the frequency of signal 324 which typically corresponds to half a wavelength or a quarter wavelength is determined by either the height (h), length (l) or width (w) of container 10. If length l of container 10 is 12.2 meters (40 feet) for a wavelength of l4 would give a frequency f determined by Equation Eq. 1.

$$f=300/l/4\ \text{MHz}=1200/12.2\ \text{MHz}\approx 10\ \text{MHz} \qquad \text{Eq. 1}$$

Equation 1 gives approximately, a frequency of approximately 10 MHz for signal 324 for a wavelength l/4 or 6 MHz a for a wavelength of l/2. The choice of 12 MHz or 6 MHz for signal 324 is intended so that the inside of container 10 acts as an electromagnetic wave cavity with respect to signal 324. A similar estimation may be performed for a container of length 6.1 meters (20 feet).

Referring back to FIG. 3*e*, a response signal 322 is sensed (step 305) by transducer 306. Response signal 322 may be sensed in terms of the amplitude and phase or frequency content of response signal 322. According to an aspect of the present invention steps 303 and 305 may be first performed prior to shipping a container 10, with the amplitude, phase and/or frequency content of response signal 322 and signal 324 stored in memory 346 in a look-up table as calibration values. Decision 307 may include an evaluation of sensed signal 322. The evaluation may involve calculating a difference between phase/amplitude/frequency content of transmitted signal 324 and sensed response signal 322. and comparing with values for response signal 322 and signal 324 previously stored in memory 346 look up table. The evaluation may also further involve consideration from other sensors connected to sensor interface 345 which sense for example humidity, motion, temperature, and shipping container 10 door positioning for example. If the difference is below a certain pre-defined threshold, periodic transmission in monitoring or sleep (power saving) mode (step 303) continues. If the difference is above a certain pre-defined threshold, an alert of theft is transmitted (step 309) optionally over transceiver 341, e.g. GSM cellular, and an active mode of operation for circuit board 34 is initiated (step 311). The active mode typically may further involve the activation of transceivers 341 and GPS 343 to actively attempt communication with other communication systems such as satellite links, wide area networks (WAN), a local area networks (LAN), global system for mobile communications (GSM) gateway or portable cells or any other communication method.

The definite articles "a" or "an" as used herein, such as "a housing", "a sensor" have the meaning of "one or more" that is "one or more housings" or "one or more sensors".

Although selected embodiments of the present invention have been shown and described, it is to be understood the present invention is not limited to the described embodiments. Instead, it is to be appreciated that changes may be made to these embodiments without departing from the principles and spirit of the invention, the scope of which is defined by the claims and the equivalents thereof.

The invention claimed is:

1. A vent cover for installing on a shipping container and thereby securing the shipping container, the vent cover comprising:

a housing adapted for attaching over a vent hole of the shipping container;

a circuit board encased or enclosed in said housing;

an environmental sensor, attachable to said circuit board, for sensing an environmental parameter of the shipping container; and a wide area network transceiver, encased or enclosed in said housing.

2. The vent cover of claim 1, wherein a DC power source, for said circuit board and for said WAN transceiver, is enclosed or encased in said housing.

3. The vent cover of claim 2, wherein said DC power source is encased in said housing and said DC power source is a rechargeable battery.

4. The vent cover of claim 2, wherein said DC power source is enclosed in said housing and said DC power source is a replaceable battery.

5. The vent cover of claim 2, wherein said DC power source includes a rechargeable battery chargeable by mutual inductance through said housing.

6. The vent cover of claim 1, wherein said circuit board includes:

a satellite antenna interface for a satellite antenna; and a global positioning system (GPS) module operatively attached to said satellite antenna interface.

7. The vent cover of claim 1, further comprising:

an electromagnetic sensor adapted for transmitting an electromagnetic signal and sensing an electromagnetic response signal responsive to said transmitted electromagnetic signal.

8. The vent cover of claim 7, wherein a wavelength of said transmitted electromagnetic signal is selected to correspond to a full-wave, half-wave or quarter-wave of a dimension of said container.

9. A method for securing a shipping container, the method using a vent cover including a housing; a circuit board encased or enclosed in said housing; a wide area network transceiver encased or enclosed in said housing; and an environmental sensor, attachable to said circuit board; the method comprising:

attaching the housing over a vent hole of the shipping container;

using the environmental sensor, enabling sensing an environmental parameter of the shipping container; and responsive to said environmental parameter alerting of a potential theft using the wide area network transceiver.

10. The method of claim 9, further comprising:

transmitting an electromagnetic signal into a space of the shipping container;

sensing a response signal responsive to said electromagnetic signal from said space; and based on said response signal said alerting of a potential theft, wherein said transmitting and said sensing are performed periodically in a monitoring mode.

11. The method of claim 9 further comprising:

upon said alerting, changing from a monitoring mode to an active mode.

12. The method of claim 11, further includes:

during said active mode, communicating said alert of theft with other communication systems selected from the group consisting of: a satellite link, a wide area network (WAN), a local area network (LAN), a global system for mobile communications (GSM) gateway and a portable cell.

13. The method of claim 9, wherein said sensing and said alerting are performed using power from a direct current power source encased or enclosed in the housing.

14. The method of claim 9, wherein said environmental sensor is selected from the group consisting of an electromagnetic sensor, thermal, humidity, motion sensor, gas sensor, pressure sensor, shipping container door switch sensor, optical sensor, acoustic sensor.

15. The method of claim 9, wherein said environmental sensor is adapted to protrude through a hole in a wall of said shipping container when said vent cover is mounted on the shipping container.

* * * * *